US007368051B2

(12) United States Patent
MacMillan

(10) Patent No.: US 7,368,051 B2
(45) Date of Patent: May 6, 2008

(54) PROCESS FOR CORROSION INHIBITING COMPOSITION IN HYDROCARBON FUELS

(75) Inventor: John Alexander MacMillan, Newark, DE (US)

(73) Assignees: Octel Starreon LLC, Newark, DE (US); Associated Octel Company Limited (GB)

( * ) Notice: Subject to any disclaimer, the term of this patent is extended or adjusted under 35 U.S.C. 154(b) by 290 days.

(21) Appl. No.: 10/659,443

(22) Filed: Sep. 10, 2003

(65) Prior Publication Data

US 2004/0182743 A1 Sep. 23, 2004

Related U.S. Application Data

(60) Provisional application No. 60/410,788, filed on Sep. 13, 2002.

(30) Foreign Application Priority Data

Feb. 7, 2003 (GB) ..... 0302862.8

(51) Int. Cl.
*C10L 1/04* (2006.01)

(52) U.S. Cl. ..... 208/15; 44/398; 422/8; 560/190; 560/193; 560/198

(58) Field of Classification Search ..... 44/398; 208/15; 422/8; 560/190, 193, 198
See application file for complete search history.

(56) References Cited

U.S. PATENT DOCUMENTS

| | | | | |
|---|---|---|---|---|
| 448,586 | A | 3/1891 | Plummer | |
| 2,334,158 | A | 11/1943 | Von Fuchs et al. | |
| 3,531,414 | A * | 9/1970 | Howard et al. | 422/8 |
| 3,635,686 | A | 1/1972 | Gee et al. | |
| 4,128,403 | A | 12/1978 | Honnen | |
| 4,214,876 | A | 7/1980 | Garth et al. | |
| 4,282,007 | A | 8/1981 | Sung | |
| 4,440,545 | A | 4/1984 | Weidig | |
| 4,728,340 | A | 3/1988 | Vos | |
| 4,737,159 | A | 4/1988 | Phillips | |
| 4,874,395 | A | 10/1989 | Meyer | |
| 6,156,082 | A * | 12/2000 | MacMillan et al. | 44/398 |

FOREIGN PATENT DOCUMENTS

| | | |
|---|---|---|
| DE | 25 17 103 A1 | 11/1976 |
| GB | 576089 | 3/1946 |
| GB | 712431 | 7/1954 |
| GB | 1162919 | 9/1969 |
| GB | 2 248 068 A | 3/1992 |
| GB | 1052380 | 12/1996 |
| WO | WO 97/45507 | 12/1997 |
| WO | WO 99/51707 | 10/1999 |

* cited by examiner

*Primary Examiner*—Glenn Caldarola
*Assistant Examiner*—Prem C. Singh
(74) *Attorney, Agent, or Firm*—Fay Sharpe LLP

(57) ABSTRACT

The present invention provides a process for the production of a fuel composition having a NACE corrosion rating of between 0% and 25%, comprising the steps of: (i) contacting a fuel with a corrosion inhibitor of formula (I) to provide an initial fuel composition (I)

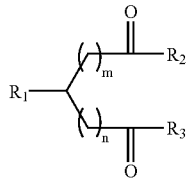

wherein m and n are each independently an integer from 0 to 10; wherein $R_1$ is an optionally substituted hydrocarbyl group; wherein either $R_2$ is $OR_4$ and $R_3$ is $OR_5$, wherein $R_4$ and $R_5$ are selected from hydrogen and hydrocarbyl-OH and wherein at least one of $R_4$ and $R_5$ is hydrogen; or $R_2$ and $R_3$ together represent —O—, and (ii) contacting the initial fuel composition with a caustic material to provide the fuel composition without subsequent addition of a corrosion inhibitor.

24 Claims, No Drawings

PROCESS FOR CORROSION INHIBITING COMPOSITION IN HYDROCARBON FUELS

This application claims priority to U.S. Ser. No. 60/410,788, filed Sep. 13, 2002.

The present invention relates to a process. In particular the present invention relates to a process for the production of a fuel additive and a fuel composition.

It is well known to those skilled in the art that hydrocarbon liquids such as fuels may corrode the metal surfaces with which they come in contact. In order to address these corrosion problems, corrosion inhibitors are often added to fuels in order to reduce or prevent corrosion of the systems in which the fuels are stored and/or handled.

In certain oil refinery applications a corrosion inhibitor is required which will be resistant to base neutralisation. The base, typically NaOH, can be present in fuels that have undergone a refinery sweetening treatment or acid neutralisation. Normally, but not exclusively, the corrosion inhibitor is added after "caustic wash". Furthermore, during distribution a fuel may come in contact with associated caustic water bottoms so the corrosion inhibitor deactivation may occur within the distribution system. The consequence of base neutralisation is corrosion inhibitor deactivation, precipitate formation and consequent levels of rust which are typical of a fuel without added corrosion inhibitor.

The present invention alleviates the problems of the prior art.

In one aspect the present invention provides a process for the production of a fuel composition having a NACE corrosion rating of between 0% and 25%, comprising the steps of (i) contacting a fuel with a corrosion inhibitor of formula (I) to provide an initial fuel composition (I)

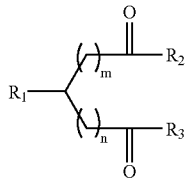

wherein m and n are each independently an integer from 0 to 10; wherein $R_1$ is an optionally substituted hydrocarbyl group; wherein either $R_2$ is $OR_4$ and $R_3$ is $OR_5$, wherein $R_4$ and $R_5$ are selected from hydrogen and hydrocarbyl-OH and wherein at least one of $R_4$ and $R_5$ is hydrogen; or $R_2$ and $R_3$ together represent —O—; and (ii) contacting the initial fuel composition with a caustic material to provide the fuel composition without subsequent addition of a corrosion inhibitor.

In one aspect the present invention provides a process for the production of a fuel composition suitable for final use, comprising the steps of (i) contacting a fuel with a corrosion inhibitor of formula (I) to provide an initial fuel composition (I)

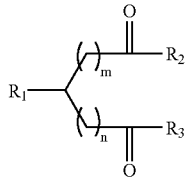

wherein m and n are each independently an integer from 0 to 10; wherein $R_1$ is an optionally substituted hydrocarbyl group; wherein either $R_2$ is $OR_4$ and $R_3$ is $OR_5$, wherein $R_4$ and $R_5$ are selected from hydrogen and hydrocarbyl-OH and wherein at least one of $R_4$ and $R_5$ is hydrogen; or $R_2$ and $R_3$ together represent —O—; and (ii) contacting the initial fuel composition with a caustic material to provide the fuel composition without subsequent addition of a corrosion inhibitor.

In one aspect the present invention provides a process for the production of a fuel composition comprising the steps of (i) contacting a fuel with a corrosion inhibitor of formula (I) to provide an initial fuel composition (I)

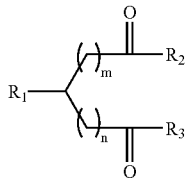

wherein m and n are each independently an integer from 0 to 10; wherein $R_1$ is an optionally substituted hydrocarbyl group; wherein either $R_2$ is $OR_4$ and $R_3$ is $OR_5$, wherein $R_4$ and $R_5$ are selected from hydrogen and hydrocarbyl-OH and wherein at least one of $R_4$ and $R_5$ is hydrogen; or $R_2$ and $R_3$ together represent —O—; and (ii) contacting the initial fuel composition with a caustic material to provide the fuel composition without subsequent addition of a corrosion inhibitor; wherein at least 10%, preferably at least 20%, more preferably at least 40%, more preferably at least 60%, more preferably at least 80% of the corrosion inhibitor of formula (I) present and active in the initial fuel composition is present and active in the fuel composition.

In one aspect the present invention provides a fuel composition obtained or obtainable by a process as herein defined.

In one aspect the present invention provides a method of inhibiting corrosion on a metal surface exposed to a fuel comprising the steps of (i) contacting the fuel with a corrosion inhibitor of formula (I) to provide an initial fuel composition (I)

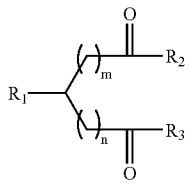

wherein m and n are each independently an integer from 0 to 10; wherein $R_1$ is an optionally substituted hydrocarbyl group; wherein either $R_2$ is $OR_4$ and $R_3$ is $OR_5$, wherein $R_4$ and $R_5$ are selected from hydrogen and hydrocarbyl-OH and wherein at least one of $R_4$ and $R_5$ is hydrogen; or $R_2$ and $R_3$ together represent —O—; (ii) contacting the initial fuel composition with a caustic material to provide a fuel composition; and (iii) exposing the metal surface to the fuel composition.

In one aspect the present invention provides use of a corrosion inhibitor of formula (I) for providing caustic wash resistant corrosion inhibition (I)

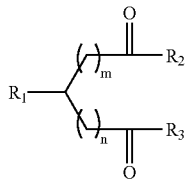

wherein m and n are each independently an integer from 0 to 10; wherein $R_1$ is an optionally substituted hydrocarbyl group; wherein either $R_2$ is $OR_4$ and $R_3$ is $OR_5$, wherein $R_4$ and $R_5$ are selected from hydrogen and hydrocarbyl-OH and wherein at least one of $R_4$ and $R_5$ is hydrogen; or $R_2$ and $R_3$ together represent —O—.

It has surprisingly been found that corrosion inhibitors of formula (I) typically retain their corrosion inhibiting properties when contacted with a caustic material. In the prior art, many corrosion inhibitors used in fuel were significantly deactivated by contact with a caustic material. The result was that fuel treated with such corrosion inhibitors displayed levels of corrosion following either a caustic wash or other contact with a caustic material that were typical of untreated fuel. This frequently necessitated the subsequent addition of further corrosion inhibitor in order for the fuel to satisfy industry standards relating to corrosion. Commonly, the deactivated corrosion inhibitor problematically precipitates from the fuel, potentially causing blocked filters. In contrast, fuels treated with a corrosion inhibitor of formula (I) display acceptable anti-corrosion characteristics even after contact with a caustic material. Thus, when a corrosion inhibitor of formula (I) is dosed into a fuel, addition of further corrosion inhibitor following a caustic wash or other contact with a caustic material may typically be avoided. Eliminating this final re-addition step provides numerous benefits including reduced cost, improved fuel quality and improved manufacturing logistics.

It is well known that the amount of sulphur contained in a fuel will decrease. For example, in anticipation of the US EPA 2006 ULSD Regulations, it is expected that sulphur levels will be progressively decreasing. The level of sulphur in fuel additives treated at the terminal will be limited to 15 ppm. Many of the corrosion inhibitors currently in use contain sulphur. Corrosion inhibitors of formula (I) typically contain no sulphur and thus provide a further advantage over many other corrosion inhibitors.

It has surprisingly been found that corrosion inhibitors of formula (I) also increase the lubricity of a fuel to which they are added. Increased lubricity prevents wear on contacting metal surfaces. The amount of wear to a surface may be measured for example by well-known tests such as the wear scar test. Corrosion inhibitors of formula (I) may therefore be used as multi-functional additives acting both as corrosion inhibitors and as lubricity additives. Therefore a fuel composition comprising a corrosion inhibitor of formula (I) may advantageously not comprise any additional lubricity additive.

The term "NACE corrosion rating" as used herein means the percentage corrosion obtained according to the NACE Standard Test Method for determining the corrosive properties of cargoes in petroleum product pipelines (TM0172-2001). Further information about this NACE Standard Test Method may be obtained from NACE International, 1440 South Creek Drive, Houston or from the NACE International website www.http://nace.org The term "fuel" as used herein refers to any liquid hydrocarbon fuel. Typical examples of a liquid hydrocarbon fuels are gasoline and diesel. As used herein, "gasoline" refers to motor fuels meeting ASTM standard D439 and "diesel" refers to middle distillate fuels meeting ASTM standard D975, and includes blends of hydrocarbon fuels with oxygenated components, such as MTBE, ETBE, ethanol, etc. as well as the distillate fuels themselves. The fuels may be leaded or unleaded and may contain, in addition to the additive compositions of this invention, any of the other additives conventionally added to gasoline, such as scavengers, anti-icing additives, octane requirement improvers, detergent packages, antioxidants, demulsifiers, corrosion inhibitors etc.

The term "hydrocarbyl" as used herein refers to a group comprising at least C and H that may optionally comprise one or more other suitable substituents. Examples of such substituents may include halo-, alkoxy-, nitro-, an alkyl group, or a cyclic group. In addition to the possibility of the substituents being a cyclic group, a combination of substituents may form a cyclic group. If the hydrocarbyl group comprises more than one C then those carbons need not necessarily be linked to each other. For example, at least two of the carbons may be linked via a suitable element or group. Thus, the hydrocarbyl group may contain heteroatoms. Suitable heteroatoms will be apparent to those skilled in the art and include, for instance, sulphur, nitrogen, oxygen, silicon and phosphorus.

The term "hydrocarbyl-OH" refers to a hydrocarbyl group with a terminal hydroxy substituent.

A typical hydrocarbyl group is a hydrocarbon group. Here the term "hydrocarbon" means any one of an alkyl group, an alkenyl group, an alkynyl group, which groups may be linear, branched or cyclic, or an aryl group. The term hydrocarbon also includes those groups but wherein they have been optionally substituted. If the hydrocarbon is a branched structure having substituent(s) thereon, then the substitution may be on either the hydrocarbon backbone or on the branch; alternatively the substitutions may be on the hydrocarbon backbone and on the branch.

The term "caustic material" as used herein relates to a material comprising at least one metal hydroxide or alkaline material. The term "alkaline material" means a material with a pH of greater than 7 when in aqueous solution.

The term "a fuel composition suitable for final use" as used herein relates to a finished fuel composition complying with industry standards relating to corrosion. It will be appreciated that the term "finished" means in a suitable condition to leave the refinery having met the approved regulatory standards.

The term "metal surface" relates to any surface comprising at least one metal. The metal surface typically comprises iron and may for example comprise an iron-containing alloy such as carbon steel. The metal surface is typically a pipeline or other metal vessel used in fuel transport and/or refinery processes.

The term "caustic wash" as used herein means contacting a fluid with an alkaline solution.

The term "caustic wash resistant corrosion inhibition" as used herein means the level of corrosion inhibition following a caustic wash is not more than 25% lower than the level of corrosion inhibition prior to the caustic wash. The corrosion inhibition is preferably measured using the NACE Standard Test Method TMO172-2001. Typically, a corrosion inhibitor which provides caustic wash resistant corrosion inhibition will achieve a NACE corrosion rating in a fuel less than 5% corrosion prior to a caustic wash. 0% corrosion indicates 100% corrosion inhibition. Following a caustic wash, the same corrosion inhibitor will achieve a NACE corrosion rating in the fuel of not more than 25% corrosion. 25% corrosion indicates 75% corrosion inhibition. Thus in the typical case there is a reduction in corrosion inhibition from 100% to not less than 75%. In other words, there is a reduction in corrosion inhibition of not more than 25%.

Corrosion Inhibitor of Formula (I)

As previously mentioned, in one aspect the present invention provides a process for the production of a fuel composition having a NACE corrosion rating of between 0% and 25%, comprising the steps of (i) contacting a fuel with a corrosion inhibitor of formula (I) to provide an initial fuel composition (I)

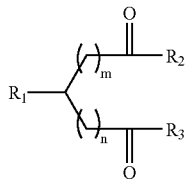

wherein m and n are each independently an integer from 0 to 10; wherein $R_1$ is an optionally substituted hydrocarbyl group; wherein either $R_2$ is $OR_4$ and $R_3$ is $OR_5$, wherein $R_4$ and $R_5$ are selected from hydrogen and hydrocarbyl-OH and wherein at least one of $R_4$ and $R_5$ is hydrogen; or $R_2$ and $R_3$ together represent —O—; and (ii) contacting the initial fuel composition with a caustic material to provide the fuel composition without subsequent addition of a corrosion inhibitor.

M and N

Preferably m and n are each independently an integer from 0 to 9, preferably 0 to 8, preferably 0 to 7, preferably 0 to 6, more preferably 0 to 5.

Preferably m and n are each independently an integer selected from 0, 1, 2 and 3.

In one aspect, preferably one of m and n is 0. In this aspect, preferably the other of m and n is other than 0.

Preferably in one aspect, one of m and n is 0 and the other of m and n is 1.

$R_1$

As previously mentioned, the corrosion inhibitor of formula (I) comprises the group $R_1$, wherein $R_1$ is an optionally substituted hydrocarbyl group.

In one aspect, $R_1$ is an optionally substituted hydrocarbon group.

As previously mentioned, the term "hydrocarbon" as used herein means any one of an alkyl group, an alkenyl group, an alkynyl group, which groups may be linear, branched or cyclic, or an aryl group. The term hydrocarbon also includes those groups but wherein they have been optionally substituted. If the hydrocarbon is a branched structure having substituent(s) thereon, then the substitution may be on either the hydrocarbon backbone or on the branch; alternatively the substitutions may be on the hydrocarbon backbone and on the branch.

Preferably $R_1$ is an optionally substituted alkyl or alkenyl group. In one aspect $R_1$ is an optionally substituted alkyl group. In another aspect, $R_1$ is an optionally substituted alkenyl group.

The term "alkenyl" refers to a branched or straight chain hydrocarbon, which can comprise one or more carbon-carbon double bonds. Exemplary alkenyl groups include propylenyl, butenyl, isobutenyl, pentenyl, 2,2-methylbutenyl, 3-methylbutenyl, hexanyl, heptenyl, octenyl, and polymers thereof.

In one aspect $R_1$ is an optionally substituted branched alkyl or alkenyl group. Preferably, $R_1$ is a polyisobutenyl (PIB) group.

Conventional PIBs and so-called "high-reactivity" PIBs (see for example EP-B-0565285) are suitable for use in this invention. High reactivity in this context is defined as a PIB wherein at least 50%, preferably 70% or more, of the terminal olefinic double bonds are of the vinylidene type, for example the GLISSOPAL compounds available from BASF.

In one aspect $R_1$ has between 5 and 200 carbon atoms, preferably between 10 and 200 carbon atoms, preferably between 10 and 100 carbon atoms, preferably between 10 and 40 carbon atoms, preferably between 12 and 32 carbon atoms such as between 12 and 26 carbon atoms.

In one aspect, $R_1$ has a molecular weight of from 100 to 2000, preferably from 200 to 800, preferably from 200 to 500, more preferably from 250 to 400 such as 260 or 360.

$R_2$, $R_3$, $R_4$ and $R_5$

As previously mentioned, the corrosion inhibitor of formula (I) comprises the groups $R_2$ and $R_3$, wherein either $R_2$ is $OR_4$ and $R_3$ is $OR_5$, wherein $R_4$ and $R_5$ are selected from hydrogen and hydrocarbyl-OH and wherein at least one of $R_4$ and $R_5$ is hydrogen; or $R_{2\ and\ R3}$ together represent —O—.

In a preferred aspect, $R_2$ is $OR_4$ and $R_3$ is $OR_5$.

In one embodiment preferably one of $R_4$ and $R_5$ is hydrogen and the other of $R_4$ and $R_5$ is hydrocarbyl-OH.

Preferably $R_4$ and $R_5$ are selected from hydrogen and $(C_xH_{2x},)$-OH wherein x is an integer of at least 1. Preferably x is an integer from 1 to 30, preferably 1 to 20, more preferably 1 to 10. In one aspect, one of $R_4$ and $R_5$ is hydrogen and the other of $R_4$ and $R_5$ is $(C_xH_{2x})$-OH.

More preferably, $R_4$ and $R_5$ are selected from hydrogen and $(CH_2)_y$-OH wherein y is an integer of at least 1. Preferably y is an integer from 1 to 30, preferably 1 to 20, more preferably 1 to 10. In one aspect, one of $R_4$ and $R_5$ is hydrogen and the other of $R_4$ and $R_5$ is $(CH_2)_y$-OH.

In a preferred embodiment each of $R_4$ and $R_5$ is hydrogen.

In one highly preferred embodiment, in the corrosion inhibitor of formula (I), one of m and n is 0 and the other of m and n is 1, $R_1$ is a polyisobutenyl group with a molecular weight of approximately 260, $R_2$ is $OR_4$, $R_3$ is $OR_5$ and each of $R_4$ and $R_5$ is hydrogen.

In one highly preferred embodiment, in the corrosion inhibitor of formula (I), one of m and n is 0 and the other of m and n is 1, $R_1$ is a polyisobutenyl group with a molecular weight of approximately 260 or 360, $R_2$ is $OR_4$, $R_3$ is $OR_5$ and each of $R_4$ and $R_5$ is hydrogen.

In one aspect $R_2$ and $R_3$ together represent —O—. In this aspect, the corrosion inhibitor of formula (I) is an anhydride of formula (II).

(II)

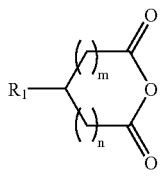

Preferred Quantities

In one aspect, in step (i), the fuel is treated with 0.25 to 20 ptb of a corrosion inhibitor of formula (I), preferably 1 to 15 ptb, preferably 1 to 12 ptb, more preferably 1 to 10 ptb.

Ptb is an abbreviation for pounds per thousand barrels. 1 ptb is equivalent to 2.85 mg/L.

In one preferred aspect, in step (i), the fuel is treated with 1 to 5 ptb of a corrosion inhibitor of formula (I), preferably 1, 2 or 3 ptb.

Caustic Material

As previously mentioned, step (ii) of the process of the present invention involves contacting the initial fuel composition with a caustic material to provide the fuel composition without subsequent addition of a corrosion inhibitor.

Preferably the caustic material is an alkaline solution. The term "alkaline solution" as used herein refers to an aqueous solution with a pH of greater than 7. In one aspect the caustic material is a 0.001% to 30% w/w alkaline solution, such as a 1% to 10% w/w alkaline solution, such as a 3% w/w alkaline solution, a 4% w/w alkaline solution or a 5% w/w alkaline solution.

In one aspect, the caustic material comprises a water-soluble metal hydroxide. Preferably the caustic material comprises a hydroxide of a metal from group 1 or group 2 of the periodic table. In one preferred aspect, the caustic material is an aqueous solution of sodium hydroxide ($NaOH_{(aq)}$) or an aqueous solution of potassium hydroxide ($KOH_{(aq)}$). Preferably, the caustic material is an aqueous solution of sodium hydroxide ($NaOH_{(aq)}$).

NACE Corrosion Rating

As previously mentioned, the present invention relates to a process for the production of a fuel composition having a NACE corrosion rating of between 0% and 25%.

In a preferred aspect, the fuel composition has a NACE corrosion rating of between 0% and 20%, preferably between 0% and 15%, preferably between 0% and 10%, more preferably between 0% and 5%. In a highly preferred aspect the fuel composition has a NACE corrosion rating of between 0% and 1%, such as between 0% and 0.5% or between 0% and 0.1%.

Method

In one aspect the present invention provides a method of inhibiting corrosion on a metal surface exposed to a fuel comprising the steps of (i) contacting the fuel with a corrosion inhibitor of formula (I) to provide an initial fuel composition (I)

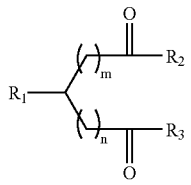

wherein m and n are each independently an integer from 0 to 10; wherein $R_1$ is an optionally substituted hydrocarbyl group; wherein either $R_2$ is OR4 and $R_3$ is $OR_5$, wherein $R_4$ and $R_5$ are selected from hydrogen and hydrocarbyl-OH and wherein at least one of $R_4$ and $R_5$ is hydrogen; or $R_2$ and $R_3$ together represent —O—; (ii) contacting the initial fuel composition with a caustic material to provide a fuel composition; and (iii) exposing the metal surface to the fuel composition.

In this aspect, preferably the corrosion inhibitor of formula (I) is as herein defined. In this aspect, preferably step (i) is as herein defined. In this aspect, preferably step (ii) is as herein defined.

In this aspect, preferably the corrosion inhibitor of formula (I) is as herein defined and/or step (i) is as herein defined and/or step (ii) is as herein defined.

Aspects of the invention are defined in the appended claims.

The present invention will now be described in further detail in the following examples.

EXAMPLES

Syntheses

PIBSA (Polyisobutenyl Succinic Anhydride)

PIBSA 260

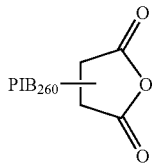

260 mwt high reactive polyisobutene (PIB) (642.3 g) was stirred in a 1l oil jacketed reactor equipped with an overhead stirrer and thermometer. The PIB was heated to 200° C. under a nitrogen atmosphere. Maleic anhydride (0.65 mole equivalents, 157.46 g) was charged to the reactor over a 3-hour period, whilst maintaining 195° C. to 200° C. The reaction mixture was then heated to 205° C. for an 8-hour period. Whilst at 205° C., a vacuum was slowly pulled on the reactor for a 1.5 hour period to remove excess maleic anhydride to <0.1% m/m. 768.9 g of product was isolated. Analysis of product gave a maleic anhydride content <0.1% m/m, a PIB content of 37% m/m and an Acid Value of 5.26 mmolH+/g.

PIBSA 360 may be made by the same method using 360 mwt PIB in place of 260 mwt PIB.

PIBS Acid (Polyisobutenyl Succinic Acid)—A Corrosion Inhibitor of Formula (I)

PIBS Acid 260

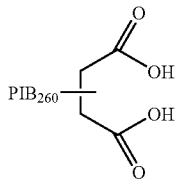

260 mwt high reactive PIB-derived PIBSA (667.5 g) was stirred with xylene (40% m/m, 445.0 g) at room temperature, in a 1l oil jacketed reactor equipped with an overhead stirrer, thermometer and condenser. Whilst at room temperature, the water (0.9 mole equivalents, 28.44 g) was charged whilst stirring and the reaction mixture heated to 90° C. for 3 hours. The solvent content and conversion was confirmed by analytical. 845.57 g of product was isolated.

Analysis of product gave a solvent content of 39% m/m and PIBSA content of 2% m/m.

PIBS Acid 360 may be made by the same method using 360 mwt PIB in place of 260 mwt PIB.

NACE Rust Test (TM 0172)

A standardised corrosion text, such as the National Association of Corrosion Engineers (NACE) standard test TM-01-72, can measure the effectiveness of corrosion inhibitors which are introduced into pipeline cargoes to prevent rusting caused by traces of moisture condensing from the products. The results of such a test are reported as a relative rating on the scale A-E.

| Rating | Percentage Corrosion |
|---|---|
| A | None |
| B++ | Less than 0.1% (2 or 3 spots of no more than 1 mm diameter) |
| B+ | Less than 5% |
| B | 5% to 25% |
| C | 25% to 50% |
| D | 50% to 75% |
| E | 75% to 100% |

TABLE 1

NACE Rust Test (TM 0172) Before Caustic Washing

| Fuel | PIBSA 360, ptb | Rating/% Corrosion |
|---|---|---|
| Isopar M | 2 | A/0 |
| Isooctane | 2 | A/0 |

PIBSA 360=Polyisobutenyl Succinic Anhydride (PIB Mwt.360)

| Fuel | DCI-30 ptb | Rating/% Corrosion |
|---|---|---|
| Isopar M | 2 | A/0 |
| Isooctane | 2 | A/0 |
| Gasoline | 2 | A/0 |
| Diesel | 2 | A/0 |

DCI-30 is 63% PIBS Acid 260 (Polyisobutenyl Succinic Acid (PIB Mwt. 260)) and 37% xylene.

The above work has been performed

These results demonstrate that DCI-30 provides excellent corrosion inhibition in different fuels.

Table 2—NACE Rust Test (TM 0172) after Caustic Washing

A sample of Canadian gasoline was dosed with varying amounts of a composition of 63% PIBS Acid 260 and 37% xylene. This composition is referred to as DCI-30 in the table below. In order to provide an aggressive test of the additive's resistance to caustic disarming, the gasoline sample was then washed with 5% vol/vol of a 4% NaOH solution according to the following method:

1. Make a 4% NaOH solution in deionized water.
2. Pour 400 ml of the gasoline sample into a 500 mL separatory funnel. Add 40 ml of the 4% NaOH solution.
3. Shake vigorously for 5 minutes, venting occasionally.
4. Allow layers to separate—about 30 minutes.
5. Drain off aqueous layer.
6. Perform NACE rust test on the gasoline sample.

The following results were obtained. Results for traditional dimer acid based corrosion inhibitor chemistries, Trad A and Trad B, are included for purposes of comparison. Trad B is a traditional dimer acid corrosion inhibitor based on conventional tall oil fatty acid chemistry. Trad A is a traditional corrosion inhibitor based on conventional tall oil fatty acid chemistry in combination with a synthetic synergist.

| Fuel | DCI-30 ptb | Rating/% Corrosion |
|---|---|---|
| Canadan RUL Gasoline | 0 | E/90 |
| Canadan RUL Gasoline | 3 | B/15 |
| Canadan RUL Gasoline | 4 | A/0 |

* The NACE rating of untreated gasoline is E99

| Fuel | Corrosion Inhibitor | ptb | Rating/% Corrosion (unwashed) | Rating/% Corrosion (washed) |
|---|---|---|---|---|
| Isooctane | — | — | D 65% | E 99% |
| Isooctane | DCI-30 | 2 | A 0% | B+ 3% |
| Isooctane | DCI-30 | 5 | A 0% | A 0% |
| Isooctane | Trad A | 2 | A 0% | E 80% |
| Isooctane | Trad A | 5 | A 0% | E 80% |
| Isooctane | Trad B | 5 | A 0% | E 85% |
| Isopar M | — | — | E 85% | D 60% |
| Isopar M | DCI-30 | 2 | A 0% | A 0% |
| Isopar M | DCI-30 | 5 | A 0% | B++ <0.1% |
| Isopar M | Trad A | 2 | A 0% | E 95% |
| Isopar M | Trad A | 5 | A 0% | E 99% |
| Isopar M | Trad B | 5 | A 0% | E 99% |
| 2002 RUL Gasoline | — | — | E 90% | D 60% |
| 2002 RUL Gasoline | DCI-30 | 2 | A 0% | C 40% |
| 2002 RUL Gasoline | DCI-30 | 5 | A 0% | B 20% |
| 2002 RUL Gasoline | Trad A | 2 | A 0% | D 60% |
| 2002 RUL Gasoline | Trad A | 5 | A 0% | C 50% |
| 2002 RUL Gasoline | Trad B | 5 | B+ 5% | E 85% |
| Diesel | — | | E 80% | D 70% |
| Diesel | DCI-30 | 2 | A 0% | C 50% |
| Diesel | DCI-30 | 5 | A 0% | B 15% |
| Diesel | Trad A | 2 | A 0% | E 85% |
| Diesel | Trad A | 5 | A 0% | E 98% |
| Diesel | Trad B | 5 | A 0% | E 95% |

These results demonstrate that by use of a corrosion inhibitor of formula (I) such as PIBS Acid 260, good corrosion inhibition is retained following a caustic wash.

TABLE 3

| | NACE Rust Test (TM 0172) Comparison with other Corrosion Inhibitors | | | | | | | | | |
|---|---|---|---|---|---|---|---|---|---|---|
| | NACE Rating | | | | | | | | | |
| | Isopar M | | | | Isooctane | | | | Gasoline washed with 4% NaOH solution | |
| ptb | 0 | 1 | 2 | 3 | 0 | 1 | 2 | 3 | 0 | 2 |
| PIBS Acid 260 | E85 | B++<0.1 | A0 | A0 | E95 | B++<0.1 | A0 | A0 | E80 | B25 |
| KS/Cl/20 | E85 | C40 | C40 | B + 1 | E95 | B++<0.1 | A0 | A0 | E80 | B10 |
| KS/Cl/21 | E85 | E85 | D75 | B20 | E95 | C40 | A0 | A0 | E80 | C40 |
| Trad B | E85 | B++<0.1 | A0 | A0 | E95 | B++<0.1 | A0 | A0 | E80 | E90 |

* The NACE rating of untreated gasoline is E99.

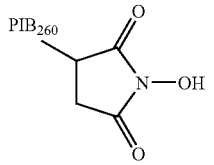

KS/Cl/20

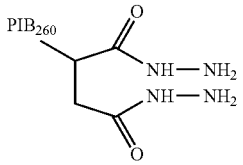

KS/Cl/21

These results demonstrate that PIBS Acid 260 provides good corrosion inhibition compared with other additives. Following a caustic wash the level of corrosion inhibition provided by PIBS Acid 260 remains high.

All publications mentioned in the above specification are herein incorporated by reference. Various modifications and variations of the described methods and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the following claims The invention of claimed is:

1. A process for the production of a fuel composition having a NACE corrosion rating of between 0% and 25%, comprising the steps of:

(i) contacting a fuel with a corrosion inhibitor of formula (I) to provide an initial fuel composition (I)

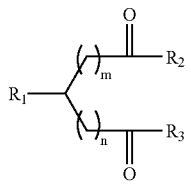

wherein m and n are each independently an integer from 0 to 10;

wherein R1 is an optionally substituted hydrocarbyl group;

wherein either $R_2$ is $OR_4$ and $R_3$ is $OR_5$, wherein R4 and R5 are selected from hydrogen and hydrocarbyl-OH and wherein at least one of R4 and R5 is hydrogen;

or $R_2$ and $R_3$ together represent —O—; and (ii) contacting the initial fuel composition with a caustic material to provide the fuel composition without subsequent addition of a corrosion inhibitor.

2. A process according to claim 1 wherein m and n are each independently an integerfrom 0 to 5.

3. A process according to claim 1 wherein one of m and n is 0 and the other of m and n is 1.

4. A process according to claim 1 wherein $R_1$ is an optionally substituted hydrocarbon group.

5. A process according to claim 1 wherein $R_1$ is an optionally substituted alkyl or alkenyl group.

6. A process according to claim 1 wherein $R_1$ is an optionally substituted branched alkyl or alkenyl group.

7. A process according to claim 1 wherein $R_1$ is a polyisobutenyl group.

8. A process according to claim 1 wherein $R_1$ has between 10 and 200 carbon atoms.

9. A process according to claim 1 wherein $R_1$ has between 12 and 32 carbon atoms.

10. A process according to claim 1 wherein $R_1$ has a molecular weight of from 250 to 400.

11. A process according to claim 1 wherein $R_1$ has a molecular weight of approximately 260 or approximately 360.

12. A process according to claim 1 wherein $R_2$ is $OR_4$ and $R_3$ is $OR_5$.

13. A process according to claim 1 wherein $R_4$ and $R_5$ are selected from hydrogen and $(C_xH_{2x})$—OH wherein x is an integer of at least 1.

14. A process according to claim 1 wherein $R_4$ and $R_5$ are selected from hydrogen and $(CH_2)_y$—OH wherein y is an integer of at least 1.

15. A process according to claim 1 wherein $R_4$ and $R_5$ are both hydrogen.

16. A process according to claim 1 wherein one of m and n is 0 and the other of m and n is 1, R1 is a polyisobutenyl group with a molecular weight of approximately 260 or 360, $R_2$ is $OR_4$, $R_3$ is $OR_5$ and $R_4$ and $R_5$ are both hydrogen.

17. A process according to claim 1 wherein, in step (i), the fuel is treated with 1 to 20 ptb of a corrosion inhibitor of formula (I).

18. A process according to claim 1 wherein, in step (i), the fuel is treated with 1 to 10 ptb of a corrosion inhibitor of formula (I).

19. A process according to claim 1 wherein, in step (ii), the caustic material is an alkaline solution.

20. A process according to claim 1 wherein, in step (ii), the caustic material is a 0.001% -30% w/w alkaline solution.

21. A process according to claim 1 wherein, in step (ii), the caustic material is a 1% -10% w/w alkaline solution.

22. A process according to claim 1 wherein, in step (ii), the caustic material is NaOH(aq) or KOH(aq).

23. A process according to claim 1 wherein, in step (ii), the caustic material is NaOH(aq).

24. A method of inhibiting corrosion on a metal surface exposed to a fuel comprising the steps of:

(i) contacting the fuel with a corrosion inhibitor of formula (I) to provide an initial fuel composition (I)

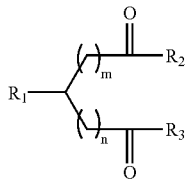

wherein m and n are each independently an integer from 0 to 10;

wherein R1 is an optionally substituted hydrocarbyl group;

wherein either $R_2$ is $OR_4$ and $R_3$ is $OR_5$, wherein $R_4$ and $R_5$ are selected from hydrogen and hydrocarbyl-OH and wherein at least one of $R_4$ and $R_5$ is hydrogen;

or $R_2$ and $R_3$ together represent —O—;

(ii) contacting the initial fuel composition with a caustic material to provide a fuel composition; and (iii) exposing the metal surface to the fuel composition.

* * * * *